US005161262A

United States Patent [19]

Quaintance, Sr.

[11] Patent Number: 5,161,262

[45] Date of Patent: Nov. 10, 1992

[54] TOILET ODOR REMOVAL APPARATUS

[76] Inventor: Edwin G. Quaintance, Sr., 4176 W. Temperance Rd., Ottawa Lake, Mich. 49267

[21] Appl. No.: 748,522

[22] Filed: Aug. 22, 1991

[51] Int. Cl.[5] ..... E03D 9/052

[52] U.S. Cl. ..... 4/213; 4/348

[58] Field of Search ..... 4/213, 216, 217, 247-352

[56] References Cited

U.S. PATENT DOCUMENTS

| | | | |
|---|---|---|---|
| 2,726,405 | 12/1955 | Smith et al. | 4/213 |
| 3,287,743 | 11/1966 | Coates | 4/213 |
| 3,689,944 | 9/1972 | Clayton | 4/213 |
| 3,781,923 | 1/1974 | Maisch et al. | 4/213 |
| 3,790,970 | 2/1974 | Bendersky et al. | 4/217 |
| 3,869,737 | 3/1975 | Stevenson | 4/213 |
| 3,887,948 | 6/1975 | Stamper | 4/213 |
| 3,913,150 | 10/1975 | Poister et al. | 4/213 |
| 4,025,325 | 5/1977 | Goodwin, Jr. | 55/357 |
| 4,031,574 | 6/1977 | Werner | 4/213 |
| 4,059,857 | 11/1977 | Poister | 4/213 |
| 4,117,559 | 10/1978 | Boyle | 4/209 |
| 4,175,293 | 11/1979 | Stephens et al. | 4/209 |
| 4,317,242 | 3/1982 | Stamper | 4/213 |
| 4,344,194 | 8/1982 | Pearson | 4/213 |
| 4,365,361 | 12/1982 | Sanstrom | 4/213 |
| 4,472,841 | 9/1984 | Faulkner | 4/213 |
| 4,493,117 | 1/1985 | Sguazzin | 4/213 |
| 4,558,473 | 12/1985 | Morikawa et al. | 4/420.2 |
| 4,726,078 | 2/1988 | Garballo et al. | 4/213 |
| 4,853,981 | 8/1989 | Hunnicutt, Jr. | 4/213 |

FOREIGN PATENT DOCUMENTS

| | | | |
|---|---|---|---|
| 2906152 | 8/1980 | Fed. Rep. of Germany | 4/217 |
| 0104635 | 8/1979 | Japan | 4/213 |

*Primary Examiner*—Charles E. Phillips

*Attorney, Agent, or Firm*—Willian Brinks Olds Hofer Gilson & Lione

[57] ABSTRACT

An apparatus for removing odors from toilets represents a new level of sophistication, adaptability, convenience, aesthetics and performance. The apparatus includes an adjustable housing having first and second sections, both with neck portions, one of which telescopes into the other to conveniently mount upon and adjust to various toilet sizes. Each section defines a wide, thin air inlet which is disposed adjacent the toilet bowl rim and which communicates with the hollow interior of the housing sections. In one section of the housing is a battery pack, timer circuit and on-off switches. In the other section is an activated charcoal filter and fan or blower which draws foul air from both air inlets, removes odors by drawing it over the charcoal filter and returning it to the ambient. The telescoping neck portions include a pair of sliding electric contacts which provide electricity to the fan motor from the battery pack and timer circuit.

16 Claims, 4 Drawing Sheets

TOILET ODOR REMOVAL APPARATUS

BACKGROUND OF THE INVENTION

The invention relates generally to devices for bathroom odor removal and air freshening and more specifically to a self-contained apparatus for odor removal for installation upon a conventional toilet including an adjustable housing having a fan and activated charcoal filter.

The challenge of removing noisome air from a bathroom is as old as indoor plumbing. Over the years inventors have tackled this problem and developed numerous and diverse apparatus for solving it. They may be categorized in many ways.

There are devices which exhaust foul air or recirculate it. A common approach is to simply draw stale or odor laden air outdoors by a fan or blower. Those that recirculate air either mask odor by scenting or perfuming it or remove odors with odor removing filtration media.

There are devices which are built into the toilet, those which utilize the plumbing as an exhaust duct, those which may be built into the toilet seat or lid and those which are attached to the toilet.

U.S. Pat. Nos. 3,689,944, 4,344,194 and 4,853,981 disclose toilet deodorizing devices installed in the toilet lid. All of these units recirculate the air and utilize an activated charcoal filter to remove odor from it.

U.S. Pat. Nos. 3,781,923 and 4,031,574 disclose devices which are both installed and cooperate with components of the toilet water tank to perform an air freshening function. In the latter patent, a mechanical timer is utilized to shut the blower off after a predetermined time interval.

U.S. Pat. Nos. 3,913,150 and 4,726,078 utilize vents in the toilet seat to remove air from the toilet bowl. In the latter patent, both air filtration and recirculation of the air as well as exhausting the air to the outside is taught.

As noted above, certain devices also withdraw air from the toilet bowl and exhaust it to the outside. Such a system is disclosed in U.S. Pat. No. 4,365,361 wherein withdrawn air is forced into the sewer line below the toilet. In U.S. Pat. No. 4,175,293, the withdrawn air is exhausted by a blower into a separate exhaust duct. A similar device is disclosed in U.S. Pat. No. 4,493,117. Here, foul air is drawn off and exhausted either through a conduit or the sewer line.

Add-on, portable devices are disclosed in U.S. Pat. Nos. 3,869,737, 4,025,325, 4,059,857, 4,317,242 and 4,472,841. In U.S. Pat. No. 3,869,737, a floor mounted device is disclosed which includes an inlet disposed at the toilet bowl rim and a deodorizing filter for removing odors from the recirculated air. U.S. Pat. No. 4,025,325 teaches a similar battery powered device. U.S. Pat. No. 4,059,857 includes a water overflow protection feature which prevents water from contacting the filter and the electric blower. U.S. Pat. Nos. 4,472,841 and 4,317,242 present add-on devices which hang on the side of the toilet bowl, are battery powered and include an odor removing filter pack.

U.S. Pat. No. 3,790,970 teaches a symmetrical unit which is disposed upon the rear portion of the toilet bowl adjacent the tank and includes a hollow toilet seat having a plurality of inlet apertures proximate the toilet bowl and a switch which operates a blower in response to weight upon the toilet seat. U.S. Pat. No. 4,117,559 teaches a similar device which is placed at the rear of a toilet bowl, includes a centrally disposed air inlet, a pair of deodorizing filters and an electric motor which drives a pair of fans. In U.S. Pat. No. 4,558,473, a multipurpose device is disclosed No. which is received on the rear of the toilet bowl and includes air filtration and recirculation means.

A review of the above discussed odor removal technology reveals certain shortcomings in nearly every design. First of all, many require cooperation with or modification of such components as the toilet seat, the toilet tank or the associated sewer line. Regardless of the device, significant and costly modification to existing equipment is necessary. Secondly, those devices which merely exhaust foul bathroom air are energy inefficient in that they generally exhaust heated or cooled air which must be replaced by unconditioned air. Such unconditioned air must be heated or cooled to the condition of the exhausted air. This process thus represents a significant waste of energy. Also, many of the devices which exhaust air necessitate the construction of an exhaust duct specifically for this purpose. This adds to the overall installation cost and complexity of such a device.

Many of the foregoing devices are powered by the alternating current supply of the house or building. In a bathroom where water and grounded metal fixtures abound, this can present a dangerous situation, particularly if the toilet is plugged, flushed and then overflows.

Finally, few of the devices discussed appear to include adjustable features which permit their installation and use upon varying toilet configurations It is therefore apparent that improvements in the technology of toilet odor removal are both possible and desirable.

SUMMARY OF THE INVENTION

The toilet odor removal apparatus of the present invention includes an adjustable housing having first and second sections, both with neck portions, one of which telescopes into the other to conveniently adjust to various toilet sizes. Each section includes a wide, thin air inlet duct which is disposed adjacent the toilet bowl rim to draw air from the bowl and which communicates with the hollow interior of the housing sections. Preferably, one section of the housing includes a battery pack, timer circuit and a pair of push button on-off switches. In the other section is an activated charcoal filter and fan or blower which draws foul air from both air inlets, through the interior of the housings, draws air over the charcoal filter to remove odors and returns it to the ambient. This arrangement of internal components provides good balance and stability of the apparatus on a toilet bowl rim. The telescoping neck portions include a pair of sliding electrical contacts which provide electricity to the fan motor from the battery pack and timer circuit.

DESCRIPTION OF THE PREFERRED EMBODIMENT

Figure 1:
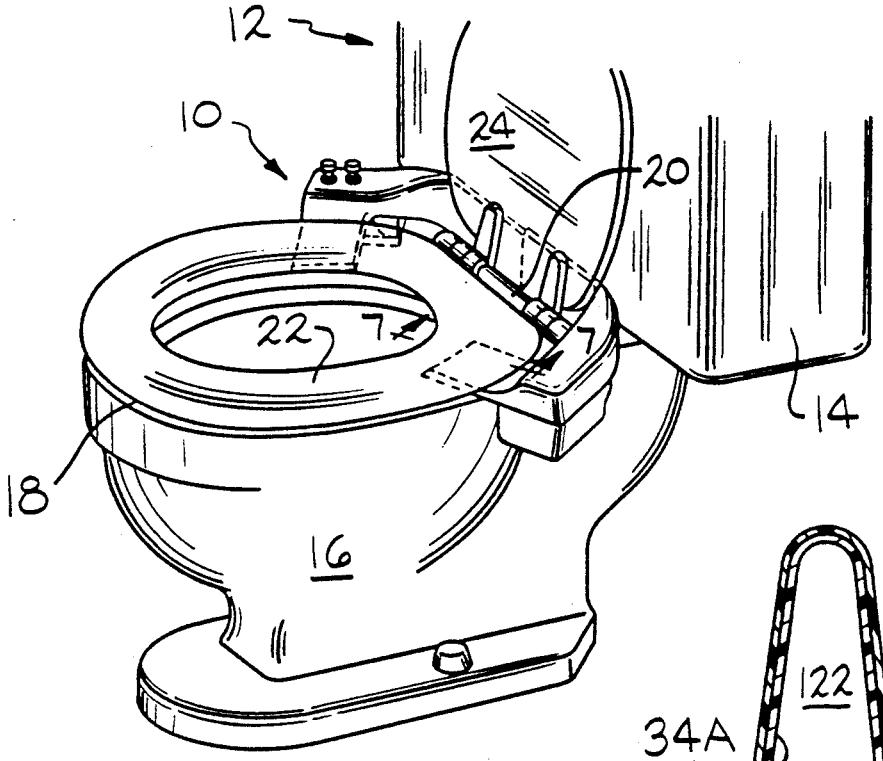
FIG. 1 is a perspective view of an odor removal apparatus according to the present invention in place upon a conventional toilet.
Figure 2:
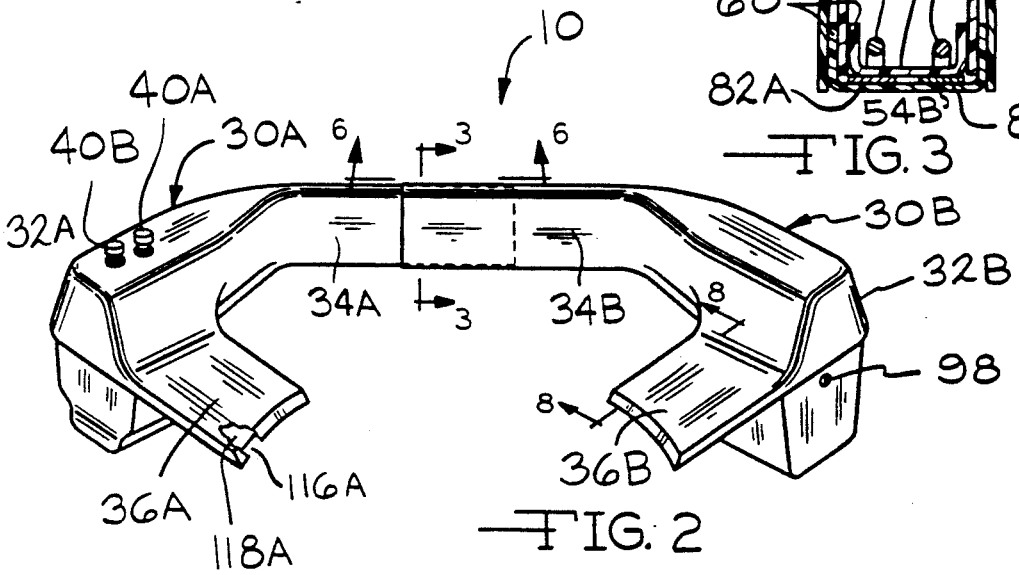
FIG. 2 is a perspective view of the odor removal apparatus according to the instant invention.

Referring now to FIGS. 1 and 2, a toilet odor removal apparatus according to the present invention is illustrated and generally designated by the reference numeral 10. The toilet odor removal apparatus 10 is intended for straightforward and direct disposition upon a conventional toilet 12. The toilet 12 includes a generally rearwardly disposed tank 14 and a forwardly disposed bowl 16. The bowl 16 includes an upper marginal edge or rim 18. Secured by a suitable hinge mechanism 20 at the rear of the rim 18 is a toilet seat 22 and toilet lid 24.

Figure 3:
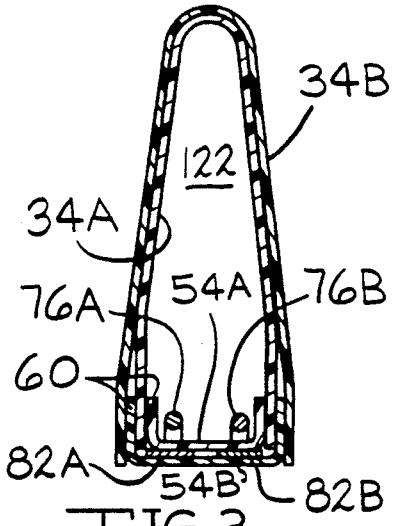
FIG. 3 is a full, sectional view of an odor removal apparatus according to the present invention taken along line 3—3 of FIG. 2.
Figure 6:
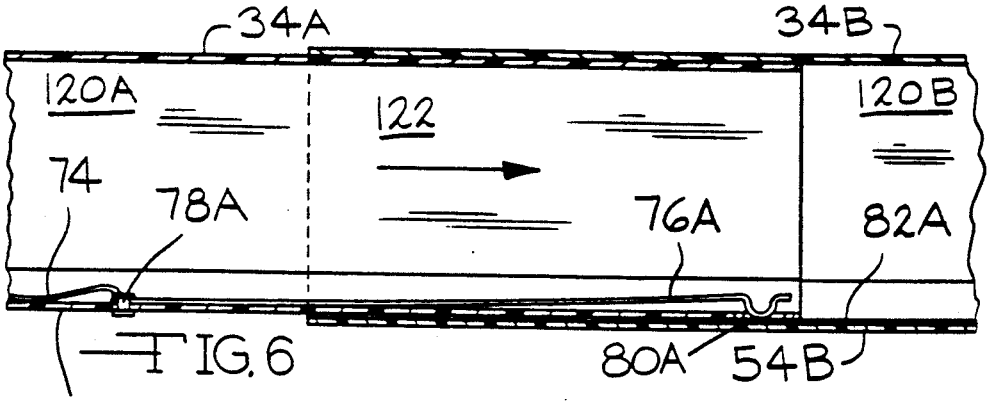
FIG. 6 is a fragmentary, sectional view of an odor removal apparatus according to the present invention taken along line 6—6 of FIG. 2.

Referring now to FIGS. 2 and 3, the odor removal apparatus 10 is substantially symmetrical and includes an upper, left housing 30A and an upper right housing 30B. The left housing 30A includes an enlarged central region 32A and the right housing 30B includes an enlarged central region 32B. The left enlarged central region 32A and the right enlarged central region 32B are coupled by respective narrow left and right triangular (in cross section) telescoping regions 34A and 34B. As illustrated in FIG. 6, the left triangular region 34A is somewhat smaller than the right triangular region 34B and slides thereinto. These male-female telescoping regions 34A and 34B provide up to approximately three inches of adjustment between the housings 30A and 30B.

Figure 7:
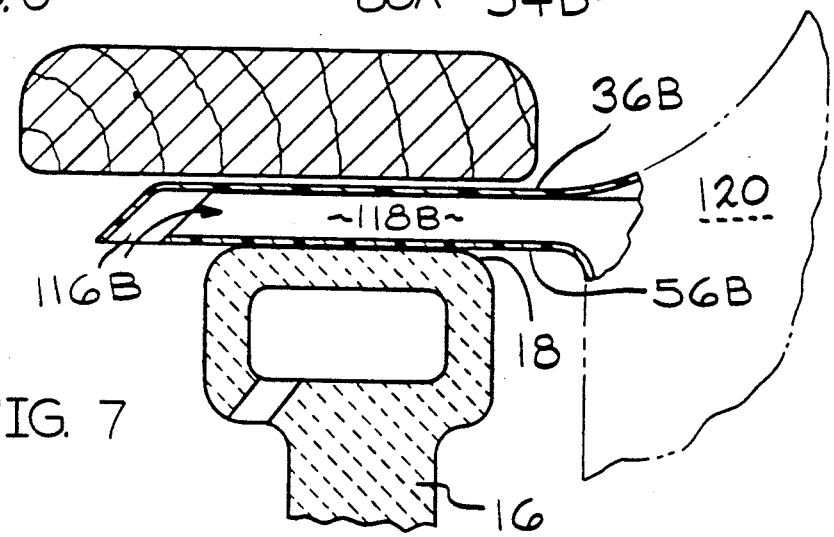
FIG. 7 is a fragmentary, sectional view of an odor removal apparatus according to the present invention taken along line 7—7 of FIG. 1.

The left housing 30A and the right housing 30B also define respective left and right air inlet ducts 36A and 36B. When placed upon the toilet 12, the inlet ducts 36A and 36B extend into the toilet bowl 16 in the space between the rim 18 and the lower surface of the seat 22 as illustrated in FIG. 7. The housings 30A and 30B, particularly the narrow, triangular sections 34A and 34B, are disposed and extend between the toilet lid 24 and the tank 14 and the apparatus 10 generally rests upon the rear portion of the toilet rim 18 with the enlarged housing sections 32A and 32B on respective left and right sides of the toilet 12 as illustrated in FIG. 1.

Positioned on the top, preferably flat surface, of the enlarged central region 32A of the left housing 30A, for convenient operation by the right hand of a person (not illustrated) seated upon the toilet seat 22, are a pair of push buttons. A first, ON push button switch 40A activates the odor removal apparatus 10 and a second OFF push button switch 40B deactivates the apparatus 10. Preferably, the ON push button switch 40A is a momentary contact, normally open type and includes a bright and highly visible color push button such as red, whereas the second, OFF push button switch 40B is a momentary contact, normally closed type and includes a dark color push button such as black.

Figure 4:
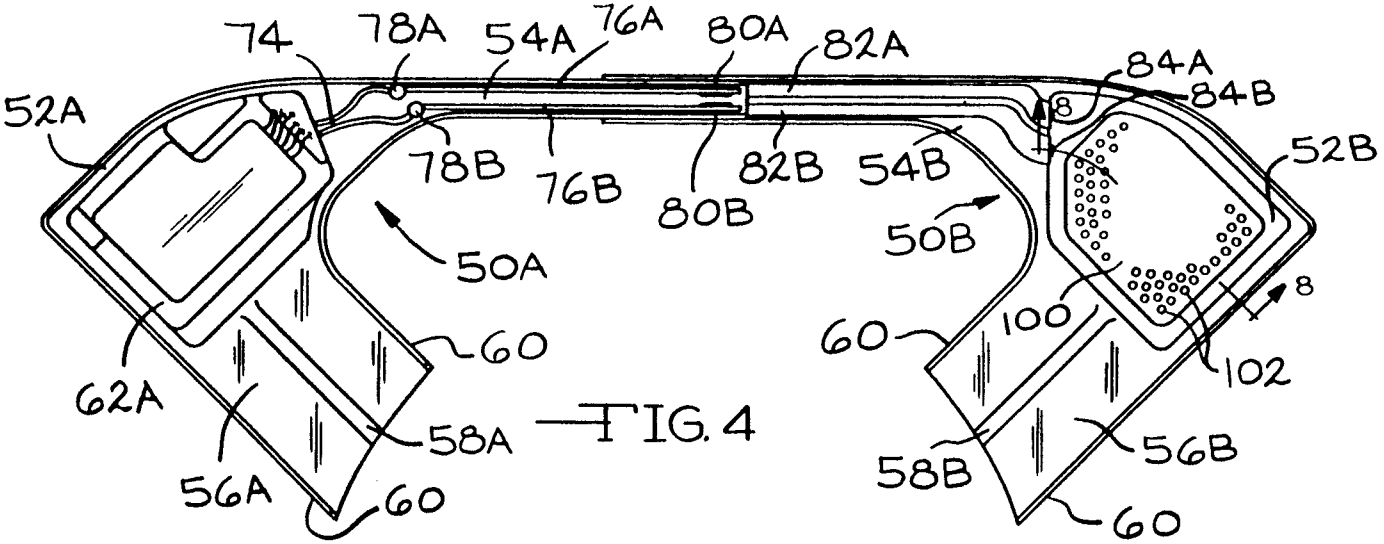
FIG. 4 is a top plan view of an odor removal apparatus according to the present invention with upper sections of the housing removed.
Figure 5:
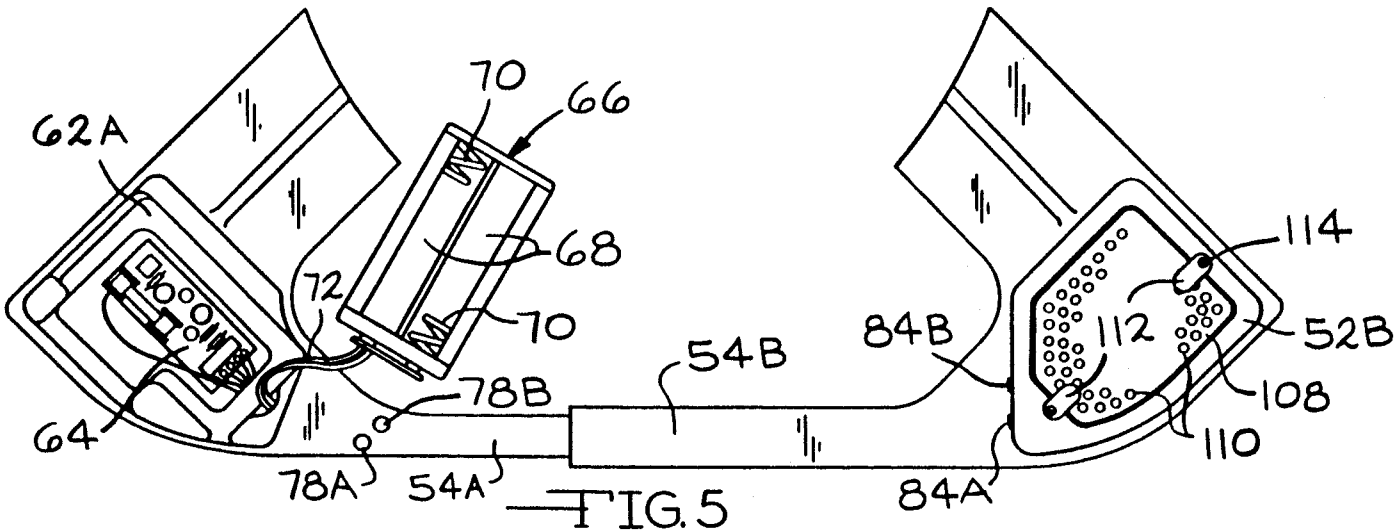
FIG. 5 is a bottom plan view of an odor removal apparatus according to the present invention with both upper and lower housing sections removed.

Referring now to FIGS. 3, 4 and 5, it will be appreciated that the left housing 30A includes a left bottom panel 50A having an enlarged central region 52A a narrow, neck region 54A and an inlet duct bottom panel 56A. The inlet duct bottom panel 56A may include a stiffening rib 58A. Correspondingly, the right bottom panel 50B includes an enlarged central region 52B, a narrow, neck region 54B and an inlet duct bottom panel 56B. The inlet duct bottom panel 56B may also include a stiffening rib 58B.

Both the left bottom panel 50A and the right bottom panel 50B define a peripheral upturned lip 60 which may be integrally formed with the bottom panels 50A and 50B. The lip 60 is preferably from about 0.25 inches to about 0.375 inches in height and is utilized to facilitate positioning and attachment of the upper housing portions 34A and 34B relative to the respective bottom panels 50A and 50B. During assembly of the apparatus 10, a bead of adhesive (not illustrated) may be disposed on the outer face of the upturned lip 60 prior to assembly of the upper housings 34A and 34B with the bottom panels 50A and 50B, respectively, to secure them together. Other fastening mechanisms such as screws or rivets or lugs which seat into complementary recesses on the mating part may be utilized.

Figure 9:
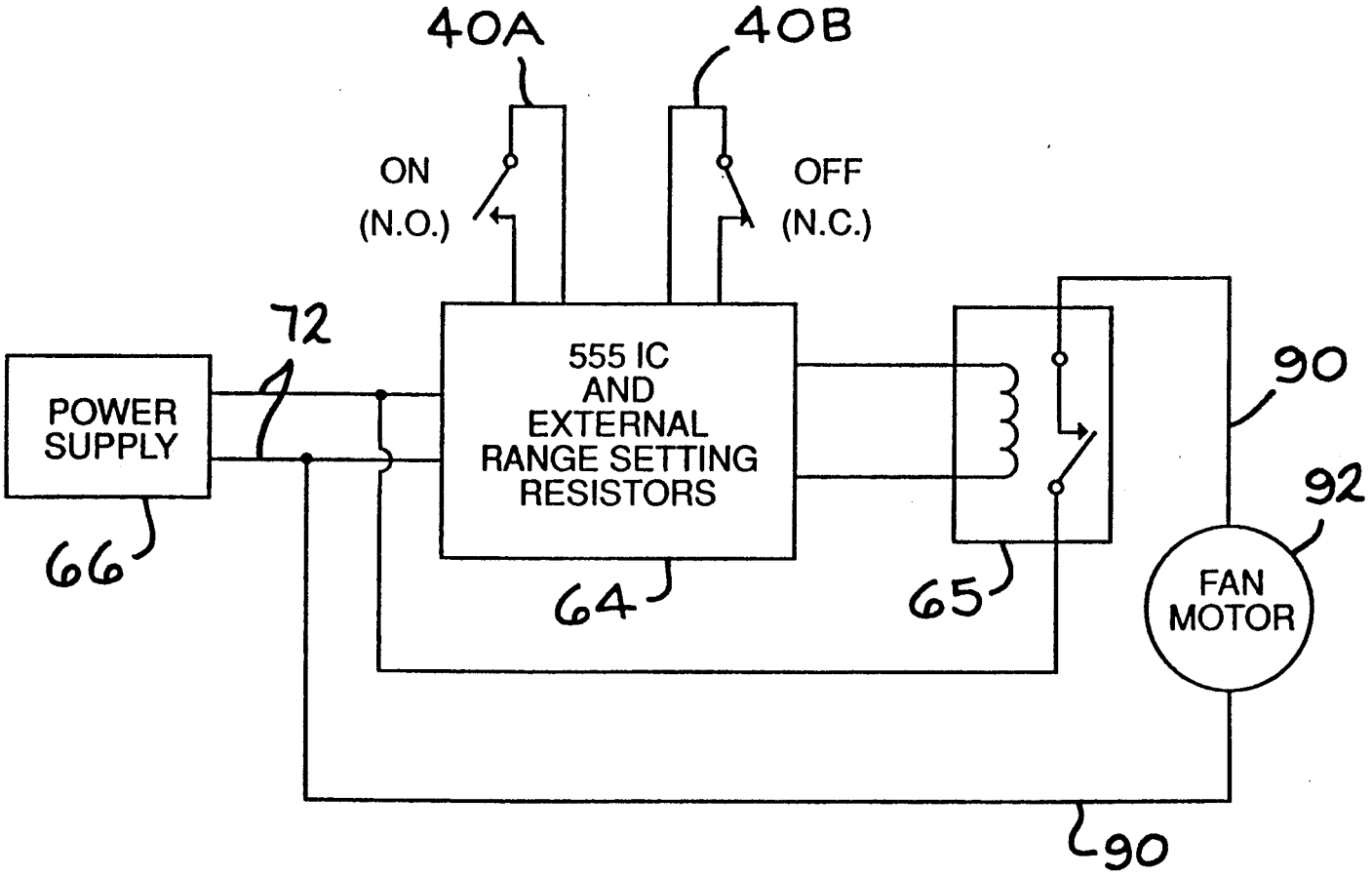
FIG. 9 is a diagrammatic view of the electrical circuitry of an odor removal apparatus according to the present invention.

As illustrated in FIGS. 2, 4 and 9, the left bottom panel 50A includes a convoluted formed region 62A which receives and secures a timer circuit board 64. A sensitive relay 65 is driven by the timer circuit on the board 64. Also received within the convoluted, formed region 62A is a power supply such as a battery pack 66. The battery pack 66 is conventional and includes a plurality of channels 68 and compression springs 70 aligned with the channels 68 for receiving and coupling in an electrical series configuration eight, one and one half volt batteries such as "C" or "D" cells such that the battery pack 66 provides an output voltage of 12 volts. The battery pack 66 is coupled to the timer circuit board 64 and other components by a pair of electrical leads 72. It will be understood that battery packs 66 providing output voltage other than 12 volts are within the scope of this invention. Alternatively, external low voltage supplies powered from the 120 V.A.C. line which deliver 6, 9, or 12 volts, for example, may also be utilized.

Referring now to FIGS. 3, 4 and 6, a second pair of leads 74 extends from the timer circuit board 64 and specifically the sensitive relay 65 and are respectively terminated by a pair of elongate spring contacts 76A and 76B having U-shaped ends which extend along the narrow, neck region 54A in parallel with one another and generally with the elongate axis of the neck region 54A. The spring contacts 76A and 76B may be fabricated of any suitable resilient contact material such as phosphor bronze or may be other gold plated metals, for example. The spring contacts 76A and 76B are secured to the left bottom panel 50A and electrically coupled to a respective one of the wires 74 by a respective one of a pair of rivets or threaded fasteners 78A and 78B. The U-shaped ends of the contacts 76A and 76B extend through suitable elongate apertures 80A and 80B, respectively, formed in the neck region 54A of the left bottom panel 50A.

When the ON button switch 40A is depressed, the timer circuit board 64 provides a 12 volt direct current output in the leads 74 to the spring contacts 76A and 76B for a period of approximately five minutes. The timer circuit board 64 includes a type 555 integrated circuit timer which drives the sensitive relay 65 which, in turn, provides a 12 volt output. Various components, i.e. resistors, on the circuit board 64 may be selected and adjusted to lengthen or shorten the timed period. At the conclusion of the timed period, the timer circuit board 64, and specifically the relay 65, terminate power to the spring contacts 76A and 76B. Alternatively, the OFF push button switch 40B may be depressed at any time during the timed ON cycle, the relay 65 is deenergized and the supply of electrical energy to the contacts 76A and 76B terminates. As an economy feature, only the ON push button switch 40A may be utilized, in which case the timer circuit board 64 will time through the preselected five minute period without interruption whenever the ON push button switch 40A is depressed and then shut off electrical power to the contacts 76A and 76B and associated components.

On the inside surface of the narrow, neck region 54B of the right bottom panel 50B are disposed a spaced-apart pair of flat, parallel electrodes or contacts 82A and 82B. The flat contacts 82A and 82B are fabricated of any suitable low resistance, non-corroding material such as phosphor bronze or may be other gold plated metal, if desired. The pair of contacts 82A and 82B terminate at a respective pair of terminals 84A and 84B which extend through a formed wall of the right bottom panel 50B in the enlarged region 52B.

Figure 8:
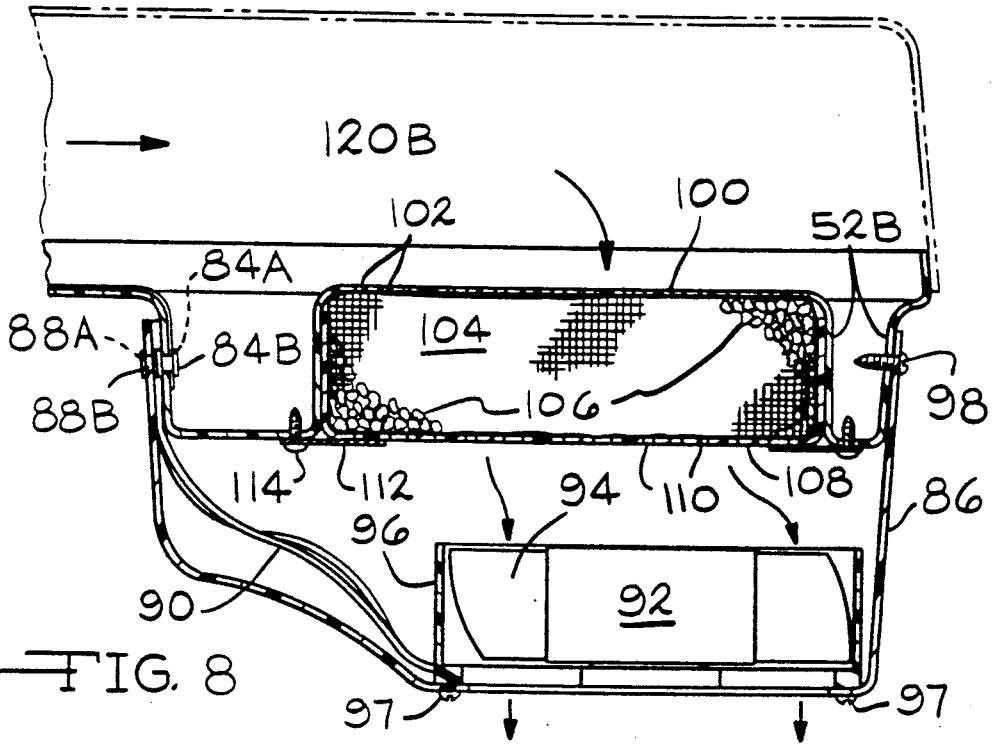
FIG. 8 is a fragmentary, sectional view of an odor removal apparatus according to the present invention taken along line 8—8 of FIG. 4 with the upper housing section shown in phantom lines.

As illustrated in FIG. 8, a removable housing shell 86 is received over the convoluted, formed region 52B and includes a pair of contacts or terminals 88A and 88B which align with and electrically connect to the terminals 84A and 84B. A pair of electrical leads 90 are coupled to and provide electrical energy to a direct current motor 92 having its output directly coupled to an axial vane fan 94. The motor 92 and the fan 94 may be like or similar to a direct current, brushless unit such as the Archer 273-243B sold by Radio Shack. The motor 92 and fan 94 are disposed in a close fitting housing 96 which is in turn secured to the shell 86 by an adhesive, a plurality of frictionally engaged stanchions or fasteners such as the threaded fasteners 97. The shell 86 is in turn removably secured to the convoluted region 52B of the right, bottom panel 50B by suitable fasteners such as threaded fasteners 98, one of which is illustrated in FIG. 8.

Referring now to FIGS. 4, 5 and 8, the formed convoluted region 52B includes a panel 100 having a large plurality of perforations 102 which defines a highly porous containing wall of an interior volume 104. The interior volume 104 receives a bag, packet or other container of activated charcoal granules 106. A cover plate 108 having a configuration corresponding to the volume 104 is received within the convoluted, formed region 52B and likewise defines a large plurality of perforations 110 which render the surface of the cover plate 108 highly porous. A pair of rotatable ears 112 secured to the convoluted region 52B by a respective pair of fasteners 114 facilitate selective release of the cover plate 108 and replacement of the packet of activated charcoal granules 106. If it is found desirable to scent the air exhausted by the fan 94, a fragrance impregnated porous material (not illustrated) may be disposed in the airflow after it exits the charcoal granules 106, for example, between the cover plate 108 and the fan 94.

The removable shell 86 provides ready access to the bag or packet of activated charcoal granules 106 to facilitate its replacement. The pairs of electrical terminals 84A and 84B and 88A and 88B permit the complete removal of the shell 86 (and components of the fan 94) through the elimination of tethering wires. It will be appreciated, however, that the terminals 84A, 84B, 88A and 88B may be replaced by uninterrupted electrical leads 90 extending from the right housing 30B which cannot be disconnected therefrom.

Referring now to FIGS. 2, 3, 4, 6 and 7, the upper left housing section 30A, specifically the inlet conduit 36A, and the lower housing panel 50A, specifically the inlet conduit bottom panel 56A define an air inlet 116A which communicates with an air passageway 118A which in turn communicates with the interior 120A of the left housing 30A defined by a upper, left housing 30A and left bottom panel 50A. The interior 120A of the left housing 30A communicates with the interior 120B of the right housing through the open region 122 of the telescoping sections 34A and 34B.

Referring now to FIGS. 2, 4, 7 and 8 the upper right housing section 30B, specifically the inlet conduit 36B, and the lower housing panel 50B, specifically the inlet conduit bottom panel 56B define an air inlet 116B which communicates with an air passageway 118B which in turn communicates with the interior 120B of the right housing 30B defined by the upper right housing 30B and right bottom panel 50B.

FIG. 9 illustrates the electrical circuitry of the apparatus 10 in diagrammatic form. The power supply 66 may be either a battery pack or a low voltage, line powered supply, as noted above. The timer circuit board 64 includes a conventional and well known 555 integrated circuit timer chip coupled to suitable push button switches 40A and 40B and range resistors providing an on cycle time of approximately five minutes. The output of the 555 integrated circuit drives a sensitive relay 65 which in turn activates the fan motor 92. While shown coupled to the leads 90 of the fan motor 92, it should be appreciated that different schemes of placement of the components in the housings 30A and 30B may require that the sliding contacts 76A, 76B, 82A and 82B be coupled to the electrical leads 72. This would be desirable if only the power supply 66 were in the left housing 30A and all other associated components (i.e., timer board 64, relay 65 and fan motor 92) were located in the right housing 30B or vice versa.

It will thus be appreciated that the components such as the push button switches 40A and 40B, the timer circuit board 64, the power supply 66, the fan 92 and the charcoal granules 106 may be arranged in the housings 30A and 30B in reverse or various fashions distinct from the configuration illustrated while still achieving the desired function.

The major housing components of the odor removal apparatus 10, namely the upper housings 30A and 30B and the bottom panels 50A and 50B are preferably a thermoplastic material such as polyvinyl chloride (PVC) or similar material which may be vacuum molded on suitable forms having a thickness of between about 0.025 inches and 0.075 inches. Alternatively, the major housing components may be injection molded of acrylonitrile-butadiene-styrene (ABS), fiberglass reinforced plastic (FRP) or other thermosets and materials having similar characteristics or die molded from plastic panels.

The foregoing disclosure is the best mode devised by the inventor for practicing this invention. It is apparent, however, that devices incorporating modifications and variations will be obvious to one skilled in the art of odor control. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. An apparatus for removing odors from air in a toilet bowl environment having a seat mounted on the bowl upper surface for disposition over a bowl rim, said apparatus comprising:

a housing including a first section defining a first air inlet for disposition adjacent the rim of the bowl and a first telescoping portion, a second section defining a second air inlet for disposition adjacent the rim of the bowl and a second telescoping portion, means for supplying electrical energy disposed in one of said sections, electrically powered air moving means disposed in the other of said sections, said first portion and said second portion providing communication between said first and second air inlets and said air moving means, activated charcoal means for removing odors from air drawn into said inlets, and contact means disposed in said first and said second telescoping portions of said first and said second sections for transmitting electrical energy from said means for supplying electrical energy to said air moving means whereby one of said first and said second portions being adjustably telescopically received in the other of said first and said second portions so as to dispose said first and said second air inlets on the rim of the toilet, while said first and second telescoping portions are disposed on the upper surface of the bowl behind the seat.

2. The apparatus of claim 1 further including control means for activating and deactivating said air moving means including a timer controlled by at least one switch.

3. The apparatus of claim 1 wherein said contact means include a pair of mating electrical contact means disposed in said first and said second telescoping portions for providing electrical energy from said first section to said second section.

4. The apparatus of claim 3 wherein one of said pair of electrical contacts is operatively coupled to said means for supplying electrical energy and the other of said pair of electrical contacts is operatively coupled to said air moving means.

5. The apparatus of claim 1 wherein said air moving means is separable from said housing.

6. An apparatus for removing odors from air in a toilet bowl environment having a seat mounted on the bowl upper surface for disposition over a bowl rim, said apparatus comprising;

a housing including a first section defining a first air inlet for disposition adjacent the rim of the bowl and a first telescoping portion, a second section defining a second air inlet for disposition adjacent the rim of the bowl and a second telescoping portion, means for supplying electrical energy disposed in one of said sections, electrically powered air moving means disposed in the other of said sections, said first portion and said second portion providing communication between said first and second air inlets and said air moving means, activated charcoal means disposed in said housing for removing odors from air passing through said housing, and contact means disposed in said first and said second telescoping portions of said first and said second sections for transmitting electrical energy from said means for supplying electrical energy to said air moving means whereby one of said first and said second portions being adjustably telescopically received in the other of said first and said second portions so as to dispose said first and said second air inlets on the rim of the toilet, while said first and second telescoping portions are disposed on the upper surface of the bowl behind the seat.

7. The apparatus of claim 6 wherein said contact means includes a pair of mating electrical contacts disposed in said first and said second telescoping portions for providing electrical energy from said first section to said second section.

8. The apparatus of claim 7 wherein one of said pair of electrical contacts is operatively coupled to said means for supplying electrical energy and the other of said pair of electrical contacts is operatively coupled to said air moving means.

9. The apparatus of claim 6 further including a timer controlled by at least one switch.

10. The apparatus of claim 6 wherein said activated charcoal is replaceable.

11. An apparatus for removing odoriferous air from a toilet bowl environment having a seat mounted on the bowl upper surface for disposition over a bowl rim, said apparatus comprising;

a housing including a first section defining a first air inlet for disposition adjacent the rim of the bowl and a first telescoping portion, a second section defining a second air inlet for disposition adjacent the rim of the bowl and a second telescoping portion, means for supplying electrical energy disposed in one of said sections, electrically powered air moving means disposed in the other of said sections, said first portion and said second portion providing communication between said first and second air inlets and said air moving means, and contact means disposed in said first and said second telescoping portions of said first and said second sections for transmitting electrical energy from said means for supplying electrical energy to said air moving means whereby one of said first and said second portions being adjustably telescopically received in the other of said first and said second portions so as to dispose said first and said second air inlets on the rim of the toilet, while said first and second telescoping portions are disposed on the upper surface of the bowl behind the seat.

12. The apparatus of claim 11 further including a timer and switch means including a first momentary contact switch for activating said air moving means and a second momentary contact switch for deactivating said air moving means.

13. The apparatus of claim 11 further including a timer and switch means including an electronic timer for activating said air moving means for a preselected period of time.

14. The apparatus of claim 11 wherein said air moving means is an axial vane blower.

15. The apparatus of claim 11 wherein said contact means defines a pair of elongate electrical contacts disposed in said female telescoping portion of said second section and a pair of spring biased contacts disposed in said male telescoping portion of said first section.

16. The apparatus of claim 11 wherein said housing sections are vacuum formed.

* * * * *